US005728006A

United States Patent [19]

Teitell et al.

[11] Patent Number: 5,728,006

[45] Date of Patent: Mar. 17, 1998

[54] MAGNETIC GOLF CLUB SWING SENSOR AND GOLF SIMULATOR

[75] Inventors: Murray Teitell, Manhattan Beach; David G. Pelka, Westchester, both of Calif.

[73] Assignee: VR Sports, Inc., Manhattan Beach, Calif.

[21] Appl. No.: 745,740

[22] Filed: Nov. 12, 1996

[51] Int. Cl.[6] ..... A63B 69/36

[52] U.S. Cl. ..... 473/151; 473/222

[58] Field of Search ..... 473/150, 151, 473/219, 221, 222, 223, 224, 225, 226

[56] References Cited

U.S. PATENT DOCUMENTS

| | | | |
|---|---|---|---|
| 3,601,408 | 8/1971 | Wright | 473/225 |
| 4,979,745 | 12/1990 | Kobayashi | 473/222 |
| 5,257,084 | 10/1993 | Marsh | 473/223 X |
| 5,472,205 | 12/1995 | Bouton | 473/222 |
| 5,501,463 | 3/1996 | Gobush et al. | 473/222 X |
| 5,527,036 | 6/1996 | Hutchings et al. | 473/222 X |
| 5,634,855 | 6/1997 | King | 473/221 |

*Primary Examiner*—William H. Grieb
*Attorney, Agent, or Firm*—Martin D. Lerner

[57] ABSTRACT

The golf game system of the present invention includes a pair of magnetic induction coil sensors to simulate the speed and, optionally, the direction of a golf swing by a golfer. The magnetic sensing system interfaces with standard software packages for a personal computer to allow a user to swing a real golf club and have the results entered and displayed by the software package. The golf game system of the present invention is useful for its recreational and entertainment value, permitting the user to practice his golf swing, and possibly for golf training and teaching applications. A magnetic strip adhesively attached to the end of the golf club locates the position of the golf club with respect to the sensors, without the need for optical sensing. An electronic circuitry panel translates the information provided by the magnetic induction coil sensors into information that is acceptable to the customized software package.

16 Claims, 2 Drawing Sheets

MAGNETIC GOLF CLUB SWING SENSOR AND GOLF SIMULATOR

BACKGROUND OF THE INVENTION

This invention relates to a simulation system for golf games. Games currently exist on the market that simulate the game of golf on a personal computer. In these games, the player uses a joystick or mouse/keyboard combination to initiate a golf swing, and the computer calculates the ball trajectory based on the length of time that the mouse and joystick are held. Other devices use this computer golf game in combination with a real golf club held by the user as an input into the computer game to therefore simulate the swing of the user. Such devices enable the user to simulate the game of golf, possibly as an instructional aid to teach people to improve their golf swing, and to provide a more realistic way to practice the game of golf. The computer screen displays the result of the golfer's swing based upon parameters input into the computer by sensors located on the swing sensor unit. It is thus possible with existing computer golf software for a game player to effectively play a full eighteen holes of golf without the inconvenience of actually getting to a golf course. Such a computer golf game might also be used as a novelty item in sports bars for those who are not regular golfers.

U.S. Pat. No. 5,472,205, to Bouton, describes such a golf game system that interfaces with existing computer software and uses electro-optical sensors to measure the golfer's swing. One disadvantage of the system of Bouton is that it relies on light emitting diodes and photodetectors that are mounted on the floor of the driving surface or on vertical posts. If the golf club were to accidently hit either the light emitting diodes or the detectors, the system could be severely damaged since both light emitting diodes and detectors are relatively fragile semiconductor devices. Furthermore, the use of optical energy as the vehicle of sensing in Bouton leads to the possibility of stray light contaminating the sensing system, and inaccurate simulation results. Particularly, the Bouton device seems to be unreliable in accurate simulation of putting.

The Bridgestone ScienceEye HD-01 is a device that uses magnetic sensors to detect and display the speed of a golf club. The Bridgestone device is placed on the floor near where the golf club is to be swung, but does not interface with a computer or any software program to display the speed or direction of the golf ball. In Bridgestone, the display is in the form of a numerical liquid crystal display that is integral with the golf sensing unit. Thus, the Bridgestone unit is not intended to be used with a simulation system.

The present golf game system also interfaces with existing computer software and employs detectors to measure the golfer's swing. However, the present device employs magnetic sensing means instead of optical sensing means, and as a result is more durable, rugged and reliable. While magnetic sensing means are generally known in the prior art, they have not been used in conjunction with golf game simulation systems. The present golf game system does not need fragile light emitting diodes because it uses only a flexible magnet on the surface of the golf club to provide an indication of the golf club position. Moreover, the magnetic sensors of the present golf game system are generally more rugged and durable than photosensors so that the overall game is more reliable than one that is based on visible light. Furthermore, the use of magnetic sensors eliminates the problem of stray light, making the overall game more reliable particularly in putting situations, where slow movement of the club might produce significant stray reflections.

SUMMARY OF THE INVENTION

It is therefore the object of this invention to produce a more durable and reliable version of a simulated golf game in conjunction with a personal computer by utilizing a magnetic sensor system.

The invention is a simulated golf game system that responds to a player swinging a club. The game includes a golf club having a flexible magnetic tape attached to the head of the golf club, a plurality of magnetic sensing units to detect the speed and direction of the golf club, an electronic circuitry panel for converting the inputs received by the magnetic sensor, a software package for interpreting the results from the electronic circuitry and calculating the game output, and a personal computer for running the software package and displaying the results. One important feature of the electronic circuitry panel is that it is electromagnetically shielded within a box housing. This eliminates the problem of environmental electromagnetic energy interfering with the operation of the circuit.

The electronic circuitry panel in a preferred embodiment employs a clock and a counter to detect the speed of the golf club. In another preferred embodiment, the electronic circuitry panel employs a comparator circuit to determine whether the ball is hit to the left or the right. The software package includes customized software in assembly language to interface the outputs of the magnetic sensors with the existing golf game software.

DETAILED DESCRIPTION OF THE PREFERRED EMBODIMENTS

Figure 1:
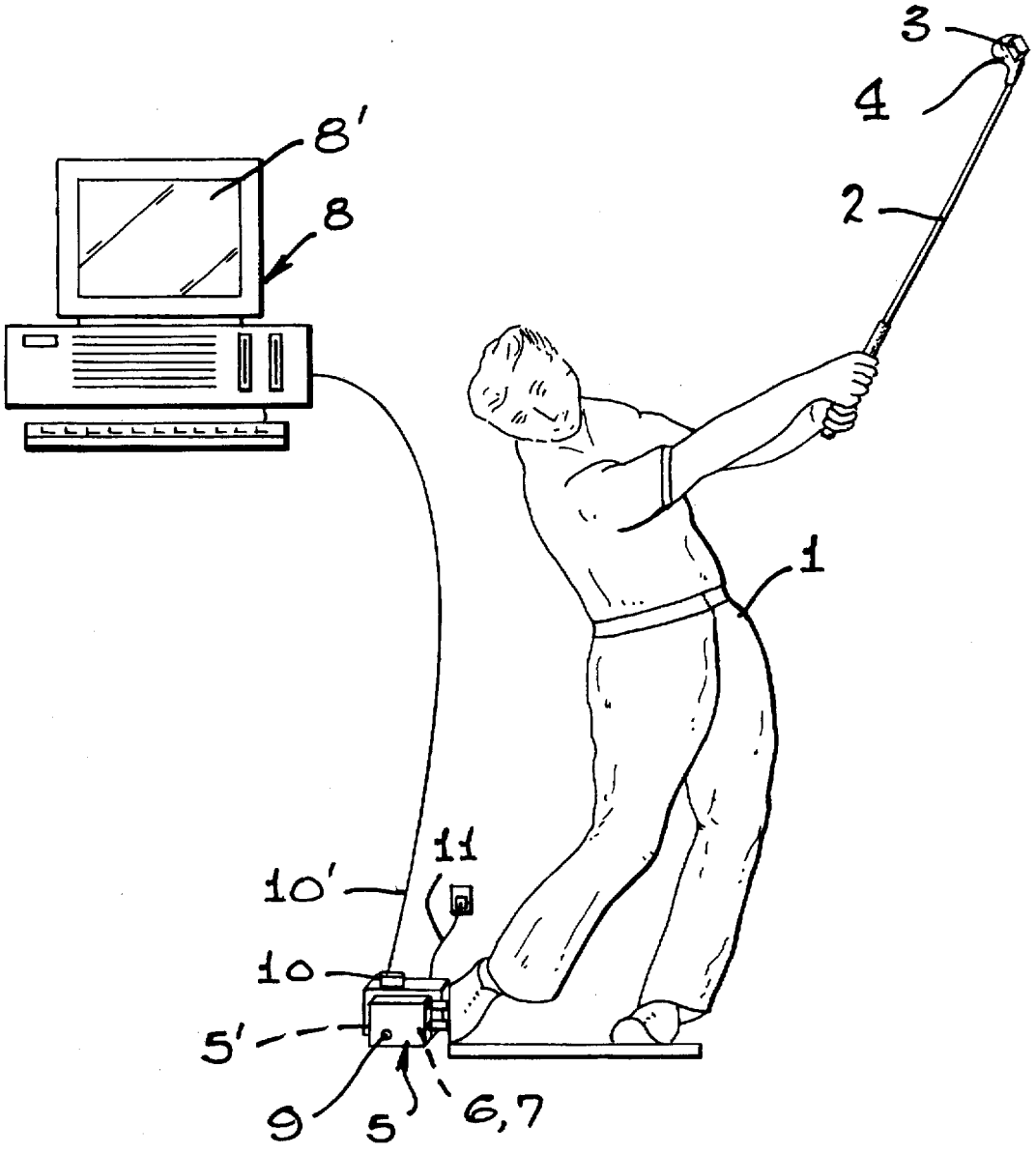
FIG. 1 is an illustration of the golf game system of the present invention.

FIG. 1 shows a golf system where a player I is swinging a golf club 2 having a flexible magnet 3 adhesively attached to the surface 4 of the golf club 2. Box 5 contains a pair of magnetic sensors 6, 7 and the electronic circuitry 5' to convert the output of the magnetic sensors 6, 7 into a format that can be understood by the personal computer 8. The magnetic sensors 6, 7 of the preferred embodiment are of a particular low resistivity design to increase the sensitivity of the device. Magnetic sensors that are 6 VDC, 32 ohm inductance coils were found to work particularly well. Box 5 also has a swing light 9, a computer connector port 10 and cord 10', and an input for a power source 11. In a preferred embodiment, the computer connector port 10 is of the the 25 pin type. Also, in the preferred embodiment, a distance of about 2.75 inches separates the magnetic sensors 6, 7. The power source 11 can either be AC or DC, utilizing a household line voltage with a transformer or four 1.5 volt batteries. The box 5 is made from a metallic or other type of material that acts to shield the magnetic sensors 6, 7 from electromagnetic energy that is in the environment and that could potentially interfere with the operation of the simulator, particularly large screen televisions, indoor fluorescent lights, and other indoor electromagnetic radiation sources.

In actually application, the golfer 1 swings his golf club 2 and the speed at which the club 2 moves past the two sensors 6, 7 is converted by a clock 18 and counter 22 in the electronic circuitry 5' into a series of pulses that enter the computer 8. The clock pulses of the magnetic sensor system are a translation of mouse pulses that would have been generated by the software game without a real club input. A software package, in this case written in assembly language, converts the outputs from the clock into the analogous mouse pulses that are recognized by the game software. The proprietary golf game software used in a particular embodiment, Links by Access Software Incorporated, Salt Lake City, Utah, requires mouse inputs that determine the distance of the backswing and the distance of the foreswing. The swing speed and clocks outputs from the box 5 have been translated into these inputs in the LINKS program for purposes of this application.

Optionally, it is also possible to choose a particular club that is used for a particular hole. Furthermore, the hole is optionally set or set by the software as is the lie of the green, and as is the golf course as a whole. The display device 8' for the personal computer 8 can be a liquid crystal display, a cathode ray tube, a projection television system, or a head mounted virtual reality display system. The game system can also be used in a non-game practice mode, such as a simulator of a driving range or a putting green.

In the golf game system of the present invention it is also possible to sense the direction of the golf club 2 using only the aforementioned pair of sensors 6, 7. In this case a comparator circuit is employed to monitor whether the golf club 2 is closer to one or other of the sensors 6, 7 during the course of the swing. If the club 2 is closer to the back sensor 6 than the front sensor 7 during the course of the swing, then the club 2 is moving from right to left, for example; if the club 2 is farther from the back sensor 6 than the front sensor 7, then the club 2 is moving from left to right. The direction of club movement is then translated into the hook (left) or slice (right) motion of the golf ball. The comparator circuit compares the peak values of the output from the magnetic sensors 6, 7 to determine which of the two sensors 6, 7 the club 2 is closer to, and converts this into signals that the particular software application can understand.

Figure 2:
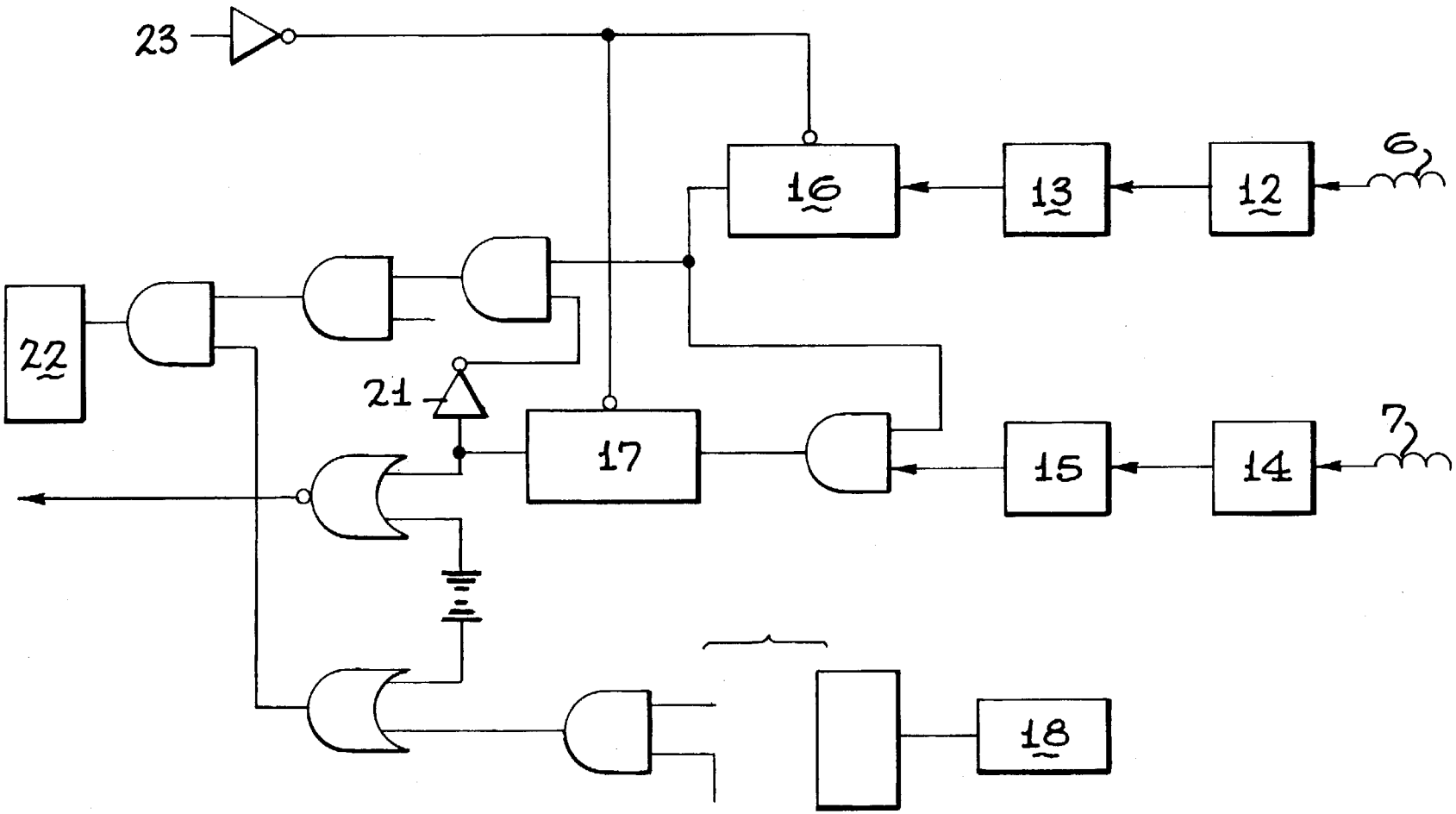
FIG. 2 is a block diagram of the electronic circuitry that converts the output of the magnetic sensors into a format that can be understood by a personal computer.

FIG. 2 shows a block diagram of the circuitry 5' that is used to convert information from the magnetic sensors 6, 7 into information that can be used by the personal computer software. When the software in the personal computer 8 is ready, pin 23 supplies a Soft Ready signal that resets the flipflops 16, 17 and turns on the swing light 21, indicating that the golfer 1 may start to play. When the golfer 1 begins the swing, magnetic sensor 6 detects the golf club 2, and the signal is sent to amplifiers 12, 13 and then to a flipflop 16. Meanwhile, timer 18 is running, and flipflop 16 turns on counter 22. When the golf club 2 passes magnetic sensor 7, the signal is sent to amplifiers 14, 15, and activates flipflop 17. The output from flipflop 17 stops the counter 22, and at the same time provides the Hard Ready signal to the software. The Hard Ready signal is sent to the software to tell the personal computer 8 that it can now read the swing data.

The golf game system of the present invention is not limited to the disclosed particulars of the preferred embodiments, but is intended to encompass all variants and modifications within the scope and spirit of the invention.

We claim:

1. A golf game system for sensing the swing of a golf club, and providing information about the swing of said golf club to a personal computer running a golf game software package, comprising:

said golf club having a flexible magnetic strip adhesively attached to an end surface of said golf club;

a pair of magnetic sensing means for detecting information about motion of said golf club by sensing velocity and path of said magnetic strip;

electronic circuit means for converting the information from said pair of magnetic sensing means into signals that are input into said personal computer;

a power supply means for supplying electrical energy to said electronic circuit means;

a software package means utilizing the signals that are input into said personal computer to produce visual display data;

visual display means for displaying said visual display data produced by said software package means.

2. The golf game system of claim 1, wherein said visual display means is a liquid crystal display system.

3. The golf game system of claim 1, wherein said visual display means is a cathode ray tube.

4. The golf game system of claim 1, wherein said visual display means is a projection television system.

5. The golf game system of claim 1, wherein said visual display means is a virtual reality display device.

6. The golf game system of claim 1, wherein said software package means includes commercially available golf game software and customized software for translating information from said electronic circuit means into information for commercially available golf game software.

7. The golf game system of claim 1, wherein said pair of magnetic sensing means detects the speed of said golf club.

8. The golf game system of claim 1, wherein said pair of magnetic sensing means detects the path of said golf club.

9. The golf game system of claim 7, wherein said electronic circuit means generates clock pulses and counts said clock pulses.

10. The golf game system of claim 8, wherein said electronic circuit means uses a comparator circuit to generate information about the difference in the inputs from said pair of magnetic sensing means.

11. The golf game system of claim 1, wherein said magnetic sensing means is a low resistance induction coil.

12. The golf game system of claim 11, wherein said magentic sensing means has a resistance value in the range of the order of 10 to 100 ohms.

13. The golf game system of claim 1, wherein said power supply means is direct current voltage supplied by batteries.

14. The golf game system of claim 13, wherein said direct current voltage is 6 volts.

15. The golf game system of claim 1, wherein said power supply means is alternating current supplied by household line voltage and a transformer.

16. The golf game system of claim 1, wherein said pair of magnetic sensing means and said electronic circuit means are enclosed in a box that provides shielding from environmental electromagnetic radiation.

* * * * *